United States Patent [19]

Souders

[11] Patent Number: 4,907,704

[45] Date of Patent: Mar. 13, 1990

[54] JEWELRY HOLDER

[76] Inventor: Karen Souders, 449 Colgate Ave., Elyria, Ohio 44035

[21] Appl. No.: 255,489

[22] Filed: Oct. 11, 1988

[51] Int. Cl.[4] ..... A47F 7/00

[52] U.S. Cl. ..... 211/13; 211/89

[58] Field of Search ..... 211/13, 60.1, 89; 206/486, 566

[56] References Cited

U.S. PATENT DOCUMENTS

| | | | |
|---|---|---|---|
| 191,647 | 4/1960 | Seeger | 211/13 X |
| 734,962 | 7/1903 | Royer . | |
| 2,058,340 | 10/1936 | Miller . | |
| 2,605,032 | 7/1952 | Hunt et al. . | |
| 2,861,682 | 11/1958 | Hatcher . | |
| 3,344,967 | 10/1967 | Kelly . | |
| 3,473,991 | 10/1969 | Ludwig . | |
| 3,718,260 | 2/1973 | Sharp | 211/13 |
| 3,783,995 | 1/1974 | Tobin | 211/113 |
| 3,845,861 | 11/1974 | Fieri . | |
| 3,933,286 | 1/1976 | Karkas . | |
| 4,099,611 | 7/1978 | Feibelman . | |
| 4,153,154 | 5/1979 | Ruscher . | |
| 4,181,224 | 1/1980 | Aber . | |
| 4,281,469 | 8/1981 | Feibelman . | |
| 4,287,986 | 9/1981 | Beck . | |
| 4,721,644 | 1/1988 | Mayo | 211/87 X |
| 4,767,011 | 8/1988 | Butler | 211/60.1 X |

*Primary Examiner*—Reinaldo P. Machado
*Assistant Examiner*—Sarah A. Lechok

[57] ABSTRACT

A holder for objects such as jewelry or the like is shown. It comprises a pad consisting essentially of resilient foamed polymer having depth sufficient for retaining the posts or pins of the objects to be held thereon and exhibiting a self-healing working surface having open cells, the surface being at least partially faced with discontinuous paint.

11 Claims, 3 Drawing Sheets

JEWELRY HOLDER

TECHNICAL FIELD

This invention relates to holders for storage and/or display of articles such as jewelry or the like, and more particularly to such holders of the pad or cushion type.

BACKGROUND ART

Some jewelry display boards and pin cushions are relevant art here. Thus, the abutting, fabric-wrapped, resilient foamed plastic bars of U.S. Pat. No. 2,861,682 were designed to hold jewelry between the bars and display it; the pin cushion kit of U.S. Pat. 3,344,967 uses a hemispherical foamed polystyrene ball; and the framed jewelry display/storage/carrying device of U.S. Pat. No. 4,181,224 has a pair of perforated plastic sheet layers overlaying a filler material that can be foamed or fibrous.

The present invention for holding objects such as jewelry and the like is subject to far fewer constraints as to shape and decoration. It can be produced very economically. It is easily decorated in a variety of ways. It has the peculiar virtue of being basically a foamed surface that is able to endure the punitive marks of service, that is the disfiguring and destructive penetrations of ear ring posts, retainers or locks, pins, etc., quite effectively while still maintaining an attractive appearance. This is particularly the case with the penetration of ear ring posts that have on them, for convenience, their small removable back-locking members. Thus, the instant holder can be considered a specialty for holding those ear rings that are made for pierced ear lobes. The usually tiny back locks need not be stored separately and, thereby, become subject to being mislaid, lost, or damaged.

BROAD STATEMENT OF THE INVENTION

The instant holder comprises a pad consisting essentially of resilient foamed polymer having depth sufficient for retaining a penetrating part of the object to be held thereon and exhibiting a self-healing working surface of open cells, the surface being at least partially faced with discontinuous paint.

DEFINITIONS

A "polymer" here means a polyurethane, a natural or synthetic rubber, a polyolefin, or the like. It can be solidly colored, multicolored (polychrome), or neutral in color, which usually is a white or an off-white.

A "resilient foamed polymer" is one having closed cell or interconnecting cell construction. Its density preferably will be between about 1 and 12 pounds per cubic foot and that can be even higher, e.g., 15. It can be made fire retardant. Generally the more rapidly the foam recovers from a surface deformation, as from the punch of the eraser end of a pencil, the better. However, even a slow, gradual, substantially complete recovery indicates adequate resiliency because recovery time is rarely of significance for the present uses. Pore diameter advantageously is up to about a millimeter in diameter, and it can be more; it need not be uniform.

"Self-healing" means the property of visually obliterating small punctures by closure, substantial restoration of surface level, and substantial disappearance of these punctures to the glance of the a casual, unaided eye.

"Contractive filaments" are fine, flexible threads that stress the foam surface. They can help close small punctures therein and possibly limit permanent surface disruption. These filaments generally are embedded in the top surface or are otherwise adherent to it. They can be a gauzy open mesh, a scrim, a light non-woven fabric, or a plurality of filaments lying mainly if not entirely in one direction, if desired. The filaments can be somewhat elastic because of their twist and/or their composition, such as some polyamides, but they do not have to be so to be effective in promoting self-healing of the surface when they adhere to it.

"Discontinuous paint" means an incomplete covering or coating of paint, enamel, varnish, lacquer, ink, stain, wash or the like on the working surface. It can be monochromatic or polychromatic, and partly or entirely in the configuration of a fanciful design or indicia, emblem, insignia, banner, or seal, etc. spread over all or over a substantial portion, e.g., preferably at least nominally (i.e., ignoring any tiny discontinuites) about a tenth to a quarter of the working surface. A preferred paint for broad or background coverage is an aqueous compounded latex paint, particularly one containing some polyvinyl alcohol and applied as a very light deposit over a thin, dried layer of aqueous borax solution or other solution of a water soluble salt as set forth in U.S. Pat. No 3,218,191. Flatness, i.e., low or no gloss, is desirable in a broad paint deposit here. Spraying, particularly with a stencil, is the preferred way of applying paint in a pattern here.

BEST MODE FOR CARRYING OUT THE INVENTION

Figure 2:
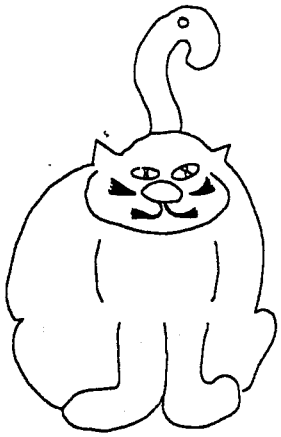
FIGS. 2–7 show in plan view a variety of fanciful stylized flat working surfaces of holders about 3/4 inch thick. Any of these can be decorated further with additional designs in discontinuous paint used in one or more colors, including black and white as colors for the instant purpose.

The silhouette of a stylized evergreen tree like that in FIG. 2 is cut out of a high density, resilient, fine-celled polyurethane foam about ½"thick. Such foam often is used for protective athletic padding, orthopedic soft goods, and furniture. Adherent to the face or working surface of the foam is a light gauzy filament about 3/32" mesh, and the silhouette has a backing of stiff cardboard glued to it. The upper part, i.e., the foliage, of the tree is spray-painted with a thin discontinuous relatively nonglossy green paint coating that hits mostly the high spots but, when viewed straight on, gives the whole surface a generally green look except for the trunk portion; that portion is coated similarly, but in a flat brown. The resulting ear ring holder can be studded with several sets of ear rings and, at the top, a stick pin to give it broadly the impression of a decorated Christmas tree.

Figure 1:
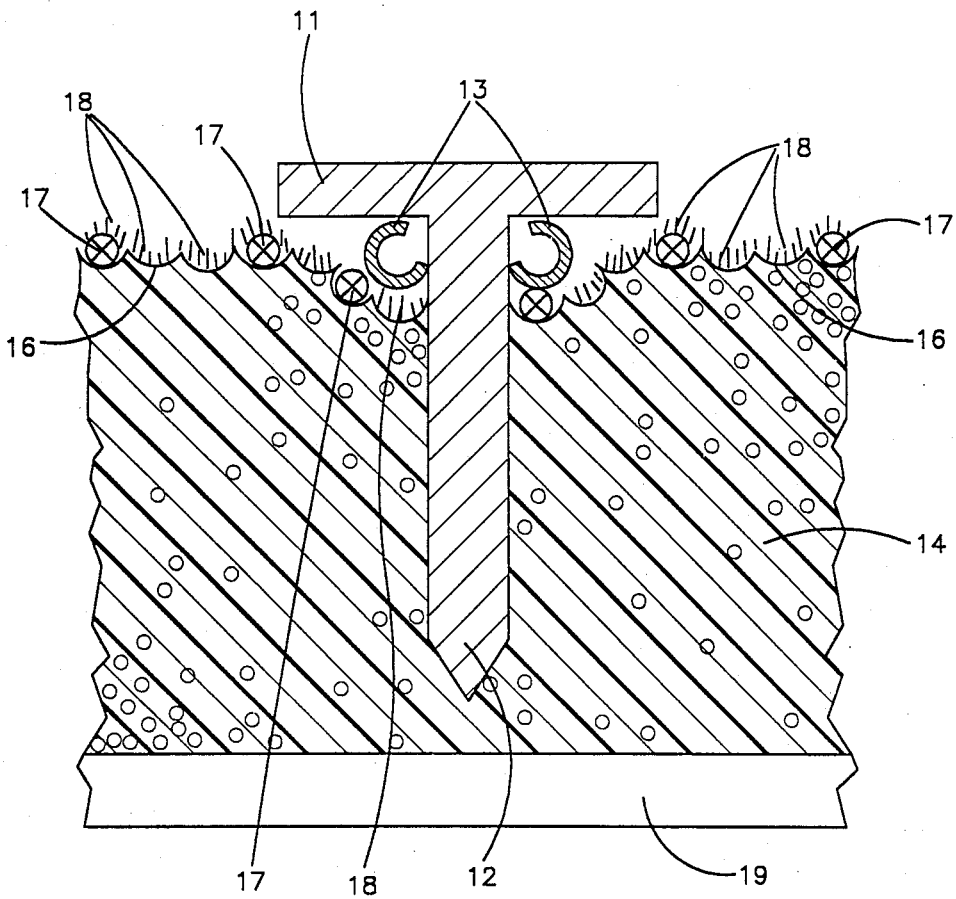
FIG. 1/ is an enlarged fragmentary cross sectional elevation through the one-inch thickness of a holder for ear rings that are made for pierced ear lobes, the section going through the vertical axis of an ear ring held thereon. Many of the dimensions and clearances are not precise, or they are exaggerated, all for simplicity of depiction.

Referring to FIG. 1, an ear ring for pierced ear lobes, having a top 11, a post 12, and a removable back-locking member 13 around the post, is held in the greensurfaced part of foam pad 14. The upper surface of the cut foam cells is represented by a series of small upwardly-looking cusps 16. The tiny "x"-centered circles 17 in the cusps represent the tiny filaments running almost invisibly in one direction in the overlying mesh fabric and intersecting like transverse filaments not seen in this view. The small irregular deposits 18 in and around the cusps and on some of the filaments are to represent the discontinuous paint. Backing 19 is glued onto the bottom of the foam pad 14.

When an ear ring and its back-lock are withdrawn for wear, the resulting puncture and depression (i.e., the wound) quickly levels out. The resiliency of the foam, aided by the filament overlay, mechanically pulls together for appreciable obliteration of the wound. This obliteration also is assisted substantially by the discontinuity of the paint; some of this effect from the paint may be mechanical, some optical. The flatness of the paint appears to assist somewhat also, and this is optical. The net effect is to make the surface appear substantially unaffected over an extended period of puncturing uses and ear ring storage periods. The mesh, additionally, may restrict or minimize disintegration of the foam structure. It is a definite asset for the holder, as is the benefit from the discontinuous paint.

The holder can be made with a self-propping member in the rear like many portrait frames, and the foam pad can be framed, if desired. The pad, or a frame or like structure around the pad, can be fitted with hooks, holes, gripper surfaces or the like to suspend the holder if that is wanted.

The designs possible formed by or drawn on the face or faces of the instant holder are limitless, as are the colors that can be used. Thus, the designs can include a written message, surface contour as well as edge contour, a map, a person or animal or a part thereof such as a visage, a fraternal emblem, seal, or banner, a cartoon character, one or a bunch of flowers, etc.

Figure 3:
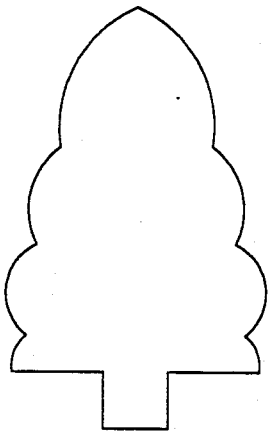
Figure 4:
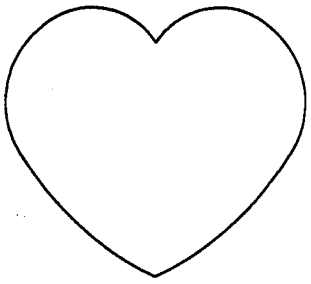
Figure 5:
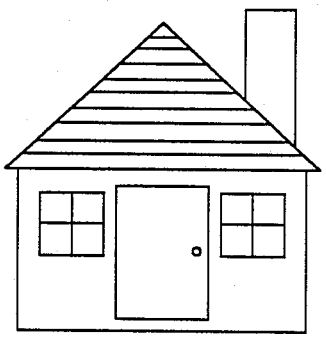
Figure 6:
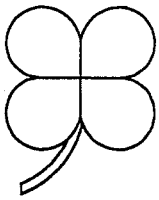
Figure 7:
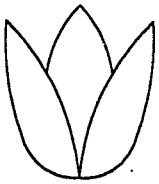
Figure 8:
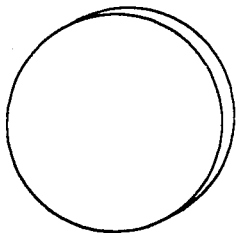
FIGS. 8–13 show in three-dimensional view representative of stylized geometric solids with the working surfaces (the surface for accepting pins and posts) spread broadly overall with discontinuous monochromatic paint as a background color. The working surfaces can be decorated further like some of those shown in FIG. 2, if desired.
Figure 9:
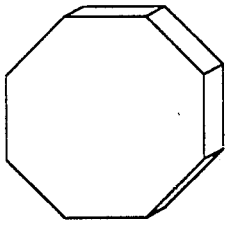
Figure 10:
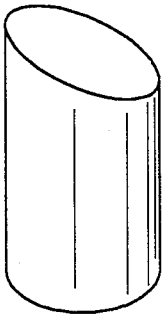
Figure 11:
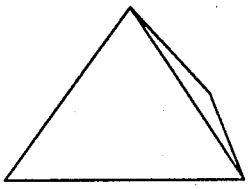
Figure 12:
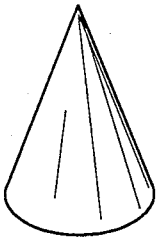
Figure 13:
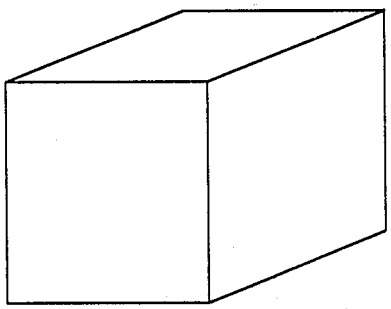

FIG. 2 shows in plan a fanciful figure of a very rotund cat with a hole for a suspension means in the tail, FIG. 3 evergreen tree referred to above, a FIG. 4 heart (which would be colored virtually all red, if desired), FIG. 5 a house, FIG. 6 a 4-leaf clover (most likely nearly all in emerald green) and FIG.7 a stylized tulip which could be in a normal tulip color or in several different colors for a special effect. Alternatively, the suspension of the cat figure could be by the crooked tail itself, a hook built therein, or a patch of Velcro. fastener on the back to attach to a mating surface on a wall.

The geometric forms of FIGS. 8–13 further emphasize the freedom of form for the instant invention. Many of these forms stand up by themselves and lend themselves to display; they can be made rigid or collapsible as desired.

Many other modifications and variations of the invention will be apparent to those skilled in the art in the light of the foregoing disclosure and drawings. Therefore, it is to be understood that, within the scope of the appended claims, the invention can be practiced otherwise than has been specifically shown and described.

I claim:

1. A holder for an object such as jewelry or the like which has a pin-like penetrating part and a shorter protrusion on one side, the holder comprising a pad having a self-healing working surface that exposes a multitude of open cells and has an at least partial facing of discontinuous paint on said working surface, said open cells and discontinuous paint being for the purpose of assisting to obliterate puncture marks from service, the pad having sufficient depth for gripping and retaining the pentetrating part of the object to be held, the pad consisting essentially of resilient foamed polymer, the working surface being readily penetrable by the penetrating part and depressible by the shorter protrusion for the purpose of accepting said penetrating part that is to be gripped and retained by the foamed polymer.

2. The holder of claim 1 wherein the surface is provided with contractive filaments.

3. The holder of claim 2 wherein the filaments are those of a light gauzy open fabric.

4. The holder of claim 1 which includes a backing.

5. The holder of claim 1 wherein the working surface is substantially flat.

6. The holder of claim 1 wherein the paint includes a design and/or indicia.

7. The holder of claim 1 which is of a fanciful shape.

8. The holder of claim 1 which is integral with a support.

9. The holder of claim 1 which is adapted for suspension.

10. The holder of claim 1 wherein the paint has a flat finish.

11. The holder of claim 1 wherein nominally at least about 10% of the working surface is faced with the discontinuous paint.

* * * * *